United States Patent [19]

Thausing et al.

[11] 3,969,041

[45] July 13, 1976

[54] SHUT-OFF VALVE FOR AUTOMOTIVE FUEL FLOW

[75] Inventors: Heinrich E. Thausing, St. Louis, Mo.; Roger G. Wallis, Belleville, Ill.

[73] Assignee: ACF Industries, Incorporated, New York, N.Y.

[22] Filed: Dec. 23, 1974

[21] Appl. No.: 535,912

[52] U.S. Cl. ..... 417/295; 417/458; 417/507; 137/494; 137/525; 251/55

[51] Int. Cl.[2] ..... F04B 49/10

[58] Field of Search ..... 137/494, 483, 525, 505.13, 137/514, 514.3, 514.5, 514.7, 525.1; 123/136; 251/48, 55; 417/279, 298, 507, 542, 297, 540

[56] References Cited

UNITED STATES PATENTS

| | | | |
|---|---|---|---|
| 963,385 | 7/1910 | Oleson | 137/514.5 |
| 1,980,091 | 11/1934 | Rockwell | 417/279 |
| 2,571,893 | 10/1951 | Kendall | 137/525 X |
| 2,575,384 | 11/1951 | Horton | 137/483 X |
| 2,657,037 | 10/1953 | Braun | 251/55 X |
| 2,824,573 | 2/1958 | Mason et al. | 137/505.13 |
| 3,021,828 | 2/1962 | Frank | 137/494 X |
| 3,059,637 | 10/1962 | Senne | 137/525 X |
| 3,368,538 | 2/1968 | Pauli et al. | 417/279 |
| 3,454,182 | 7/1969 | Morton | 137/525 X |
| 3,620,198 | 11/1971 | Breitschwerdt | 123/136 |
| 3,730,215 | 5/1973 | Conery | 137/494 |
| 3,769,952 | 11/1973 | Fiedler et al. | 123/136 |
| 3,923,425 | 12/1975 | Porter | 417/298 |

*Primary Examiner*—Martin P. Schwadron
*Assistant Examiner*—Robert J. Miller

[57] ABSTRACT

A shut-off valve for the automotive fuel system is operable to shut off the fuel flow whenever a positive pressure exists in the fuel line between the fuel tank and the shut-off valve. The shut-off valve may be employed in combination with a fuel pump or may be employed separately in the fuel line and comprises a flexible diaphragm connected by a stem directly to the valve member and movable with the valve member. The diaphragm air chamber has an air vent controlled by a vent valve providing a relatively large opening for bleeding in air and providing a relatively small opening for exhausting air from the diaphragm air chamber. The vent valve thus permits a relatively fast movement of the valve member to an open position and a relatively slow or restricted movement of the valve member toward a closed or partially closed position.

8 Claims, 7 Drawing Figures

SHUT-OFF VALVE FOR AUTOMOTIVE FUEL FLOW

BACKGROUND OF PRESENT INVENTION

Heretofore, fuel leaks have developed in the fuel system between an automotive fuel pump and the intake manifold of the engine. This has resulted from malfunctioning fuel inlet valves in the carburetor and vehicle accidents which cause a vehicle to overturn or at impacts which might rupture a fuel line. Further, it is desirable to have a fuel system in which at a vehicle impact of thirty miles per hour no more than one ounce per minute of fuel is leaked from the fuel system. A design to meet this condition is facilitated by a shut-off valve for use with the automotive fuel system with the valve operable to shut off the fuel flow whenever a positive pressure exists in the fuel line from the fuel tank to the shut-off valve.

The leakage of fuel is severe if the vehicle is at rest and the fuel tank is disposed at an elevation higher than the carburetor or engine of the car and this condition frequently exists after overturning of the vehicle or upon impact. The fuel then flows by gravity from the storage tank and if a break in the line or some other leakage occurs, the fuel will flow from the storage tank to create a possible hazard.

The present invention is an improvement over the fuel pump shut-off valve shown in assignee's co-pending application Ser. No. 474,501 to David L. Porter and Raymond E. Williamson, filed May 30, 1974, now U.S. Pat. No. 3,923,425 and entitled, "Fuel Pump Shut-off Valve." Application Ser. No. 474,501 now U.S. Pat. No. 3,923,425 discloses a fuel pump shut-off valve in which the shut-off valve is employed in combination with the fuel pump and is effective to shut off fuel flow whenever a positive pressure exists in the fuel line from the storage tank to the fuel pump.

BRIEF DESCRIPTION OF THE INVENTION

A shut-off valve positioned in the fuel line for shutting off the flow of fuel whenever a positive pressure exists in the fuel line between the fuel tank and the shut-off valve. The shut-off valve may be placed in the fuel line between the supply tank and the fuel pump or be a part of the fuel pump structure. When employed with the fuel pump structure, the shut-off valve is employed in combination with the inlet check valve of the fuel pump but does not itself form the inlet check valve.

Upon starting of the engine and the reciprocating of the fuel pump, the shut-off valve immediately moves to a full open position in a minimum of time thereby not to restrict or hinder the flow of fuel including vapor from the fuel tank through the fuel pump. It is desirable that the shut-off valve remain in a substantially full open position during the entire operation of the engine without any hindrance to fuel flow and particularly under a vapor-lock condition in which a relatively large amount of vapor may be conveyed through the fuel line.

The present invention is directed particularly to a shut-off valve which opens in a relatively short period of time but which moves towards a closed position at a relatively slow rate therefore not to result in the closing or partial closing under various engine operating conditions. The shut-off valve is connected to a flexible diaphragm for movement with the diaphragm and is provided with a vent valve structure for an air vent to the diaphragm chamber. The valve structure for the air vent is provided so that air is added to the diaphragm chamber at a relatively fast rate during movement of the shut-off valve to an open position while air is exhausted from the diaphragm chamber at a relatively slow rate during movement of the shut-off valve toward a closed position. Thus, the movement of the shut-off valve toward a closed position is resisted by the slow rate of air exhaust from the diaphragm chamber and the shut-off valve is not apt to respond very fast to fluctuations in pressure within the fuel line thereby remaining in a fully or substantially fully open position throughout the operation of the engine. When the engine is shut down, positive pressure provided in the fuel line by fuel from the fuel tank moves the diaphragm for the shut-off valve to the closed position of the shut-off valve thereby to stop the flow of fuel through the fuel line to the fuel pump.

In the accompanying drawings, in which several of various possible embodiments of the invention are illustrated, FIG. 1 is a schematic view illustrating the shut-off valve comprising the present invention in use in combination with the fuel pump on an internal combustion engine of an automotive vehicle;

Figure 1:
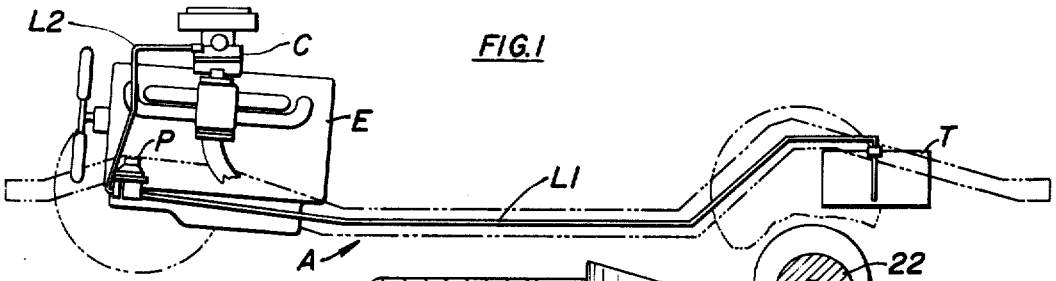

Referring to FIG. 1 of the drawings, an automotive vehicle is generally indicated at A having an engine E on which is mounted a fuel pump structure P. Fuel is delivered from a fuel tank T of the vehicle through a supply line L1 to fuel pump P and delivered by fuel pump P through line L2 to carburetor C of engine E. Pump P as shown particularly in FIG. 2 includes a rocker arm housing 12 having a flange 14 thereon which is adapted to attach to engine E. A rocker arm indicated generally at 16 is mounted about pivot 18 within housing 12 for rocking movement about a horizontal axis transverse to housing 12. Arm 16 has an outer end portion 20 which engages an engine-driven eccentric cam 22. The low point of cam 22 engages rocker arm end portion 20 and upon rotation of cam 22 rocker arm 16 is moved in a clockwise direction from the position shown in FIG. 2.

Extending downward from rocker arm housing 12 is a hollow generally conical pump head or housing 24 having a peripheral flange 26 thereon. A downwardly facing portion of flange 26 forms a seat for a marginal portion of diaphragm 28 which may be formed of a relatively thin disc of flexible fuel-resistant material, such as a suitable synthetic rubber. The outer marginal portion of diaphragm 28 is clamped against flange 26 by a pump body generally indicated at 30 having an outer marginal portion 32 which is crimped around the outer surface of flange 26. Outer marginal portion 32 of pump body 30 provides a fuel-type seal about the outer marginal portion of diaphragm 28.

Diaphragm 28 is clamped between upper and lower plates 34 and 36. An actuating rod 38 for diaphragm 28 has a lower end portion secured to plates 34 and 36. The upper end of rod 38 has a head 40 and a spring retainer 42 is secured to rod 38 about head 40. A spring 44 is biased between pump housing 24 and retainer 42 to urge rod 38 and diaphragm 28 downwardly in a pumping stroke. When rocker arm 16 moves in a clockwise position from the position shown in FIG. 2, diaphragm 28 is moved upwardly in a suction stroke and when rocker arm 16 moves in a counterclockwise direction, diaphragm 28 is driven downwardly under the force of spring 44 in its pumping stroke. A pumping chamber 46 is formed beneath diaphragm 28.

Pump body 30 is formed of sheet metal and has integral generally cylindrical inlet and outlet projections 48 and 50, respectively. An outlet nipple 52 is connected to outlet fuel line L2 and leads from outlet projection 50. An inlet nipple 54 is connected to inlet line L1 and leads to inlet projection 48. A discharge check valve 56 is provided in projection 50 and an intake check valve 58 is provided in projection 48. The check valves are of identical construction and may be of a type well known in the fuel pump art, each comprising a valve seat 60 for a disc valve member 62 and a mushroom head stem 64 extending from valve seat 60. A spring 66 surrounds the stem 64 and urges disc valve member 62 toward its respective seat. Seats 60 are press fitted within projections 48 and 50 with valve members 62 positioned reversely with respect to each other so that inlet check valve 58 opens in one direction and discharge check valve 56 opens in the opposite direction.

Mounted below inlet check valve 58 is a shut-off valve generally designated 70 and forming the present invention. Projection 48 has an inwardly directed lower flange 72 and an outer housing 74 for shut-off valve 70 is secured to projection 48. Housing 70 has a lower out-turned flange 76 and a plurality of radially spaced extensions 78 extend outwardly from flange 76 each having a threaded opening 80 therein.

Figure 2:
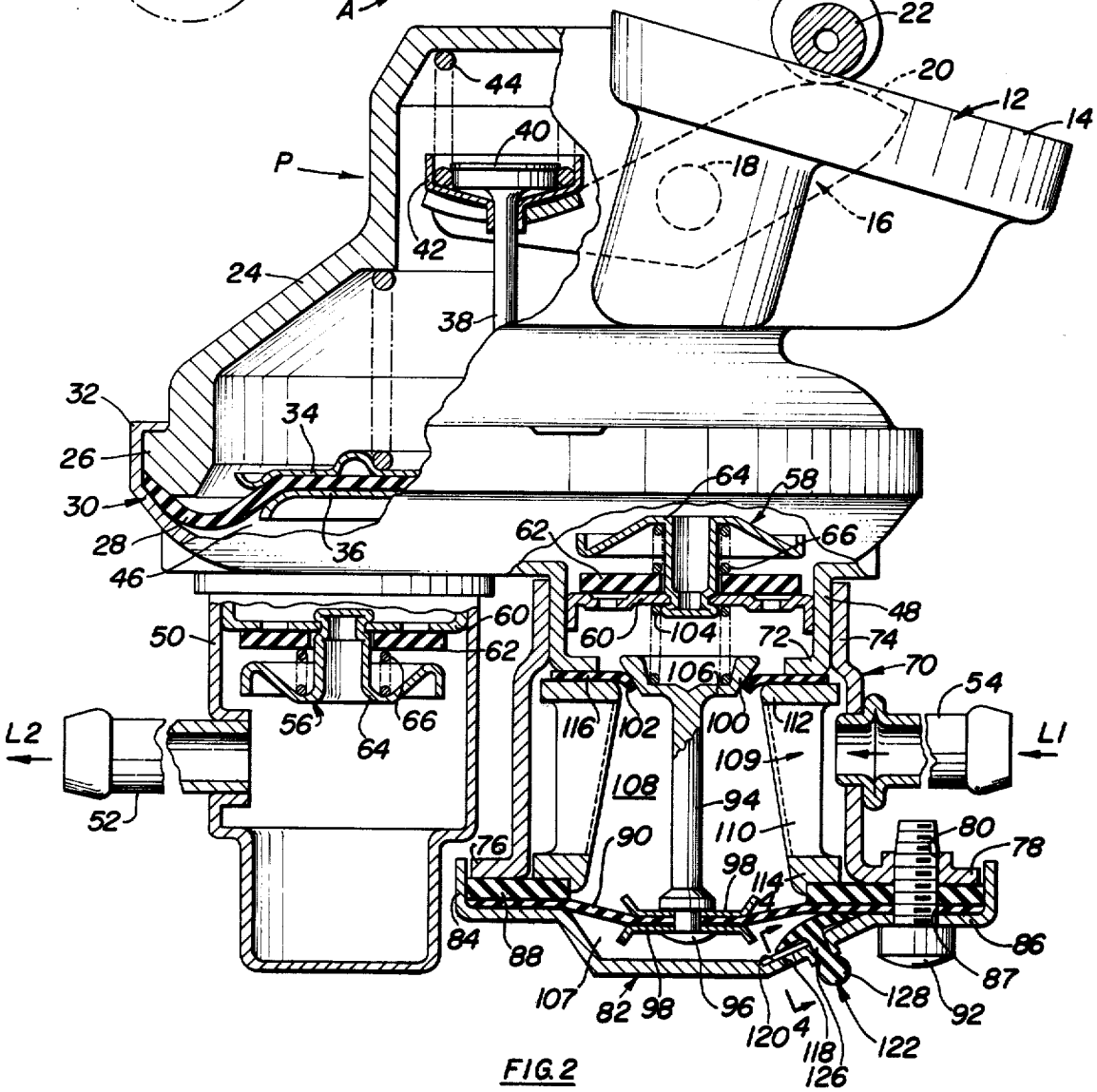
FIG. 2 is an enlarged vertical section of the combined fuel pump and shut-off valve structure shown in FIG. 1 in a closed position.

A lower cap generally designated 82 has an annular flange 84 and a plurality of extensions 86 with openings 87 are provided thereon in alignment with extensions 78 on annular flange 76. An annular gasket 88 is positioned adjacent flange 76 and a flexible diaphragm 90 has its outer marginal portion gripped between gasket 88 and cap 82. Threaded studs 92 are received within openings 87 and threaded within openings 80 for securing cap 82 about housing 70 and gripping the outer marginal portion of diaphragm 90 therebetween. A valve stem 94 has a lower end portion 96 securing a pair of metal plates 98 about diaphragm 90. The upper head portion of stem 94 forms a valve member 100 having an outwardly flared seat surface 102. A spring 104 is biased between a recess 106 in the upper head portion of valve 100 and seat 60 to urge valve stem 94 and diaphragm 90 downwardly as viewed in FIG. 2. A diaphragm air chamber 107 is formed beneath diaphragm 90 and a diaphragm fuel chamber 108 is formed above diaphragm 90. A filter generally designated 109 has a filter screen 110 mounted between annular end portions 112 and 114. Lower end portion 114 is seated about gasket 88 and upper end portion 112 clamps an annular seal 116 against inwardly extending flange 72 on projection 48. Annular seal 116 has an inner marginal lip portion in contact with the flared surface 102 of valve member 100 when valve member 100 is in a closed position as indicated in FIG. 2 thereby to form a fluid-tight seal between valve member 100 and annular seal 116. When cap 82 is secured by threaded studs 92, filter 109 is clamped into position against seal 116 by the securement of studs 92.

Figure 4:
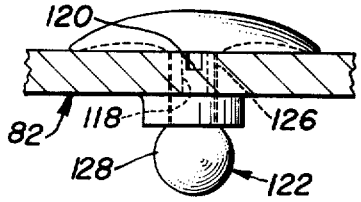
FIG. 4 is a section taken generally along line 4—4 of FIG. 2 showing the air vent valve structure for the shut-off valve.
Figure 3:
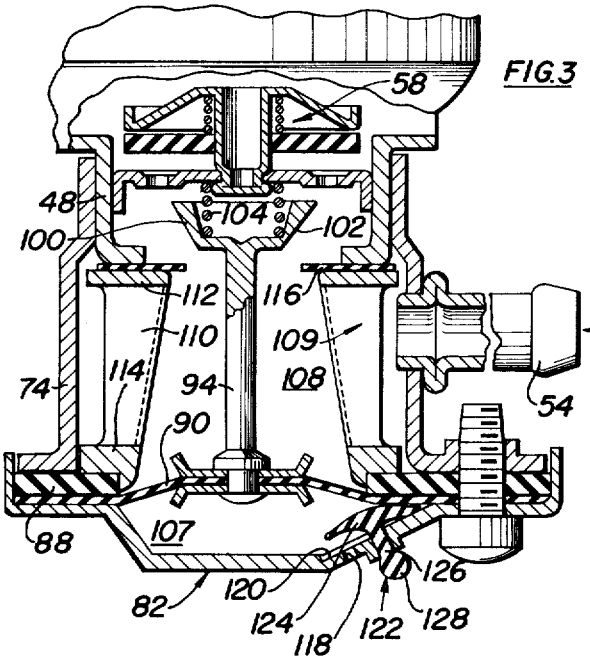
FIG. 3 is a view of the shut-off valve removed from the fuel pump structure shown in FIG. 2 with the shut-off valve shown in an open position.

Referring particularly to FIG. 4, a vent opening 118 is provided in cap 82 and a longitudinal slot 120 is in fluid communication with opening 118. A vent valve generally designated 122 has a valve body 124 and a stem 126 leading therefrom to a bulbous end portion 128 securing valve member 122 in position. Slot 120 extends outwardly of valve body 124 to provide a bypass in the closed position of valve 122. A portion of body 124 fitting over slot 120 acts as a flap and upon movement of diaphragm 90 from the position shown in FIG. 2 to the open position of valve member 100 shown in FIG. 3, a suction is exerted within the dead air space formed in air chamber 107 between cap 82 and diaphragm 90. As shown in FIG. 3 during movement of diaphragm 92 toward the open position of valve member 100, the flap portion of vent valve member 124 over longitudinal slot 120 is urged away from slot 120 thereby to provide a fast rate of air flow within the dead air chamber 107 thereby to permit a relatively fast movement of valve member 100 to the open position shown in FIG. 3. Upon the downward movement of diaphragm 90 from the position of FIG. 3 toward a closed position of FIG. 2 under the bias of spring 104 as might occur upon the shutting off of the engine or upon a positive pressure being exerted within the chamber formed above diaphragm 90, vent valve member 124 is in the position shown in FIG. 2 and a relatively slow rate of air is exhausted or bled from dead air space 107 through longitudinal slot 120 which forms an air bypass and thence through vent 118 to atmosphere thereby to provide a relatively slow rate of movement of shut-off valve member 100 towards a closed position.

The arrangement of vent valve 122 in such manner thus provides a rapid response upon the starting of the engine by the rapid movement of valve 100 to an open position. However, upon fluctuations in the fuel flow and fluctuations in pressure conditions within the fuel line and fuel chamber 108, the movement of valve 100 towards the closed position is at a relatively slow rate and thereby does not provide a rapid movement of diaphragm 90. In addition, the reciprocal movement of diaphagm 90 from such fluctuations is minimized as a result of the resistance to movement of valve 100 toward a closed position. However, upon cutting off of the engine or in the event a break occurs in the fuel line and a positive pressure is present in the inlet line between the fuel tank and the shut-off valve, the shut-off valve will move at a slow rate to a fully closed position to cease or stop the flow of fuel from the tank. In this manner, possible hazards are minimized.

Figure 5:
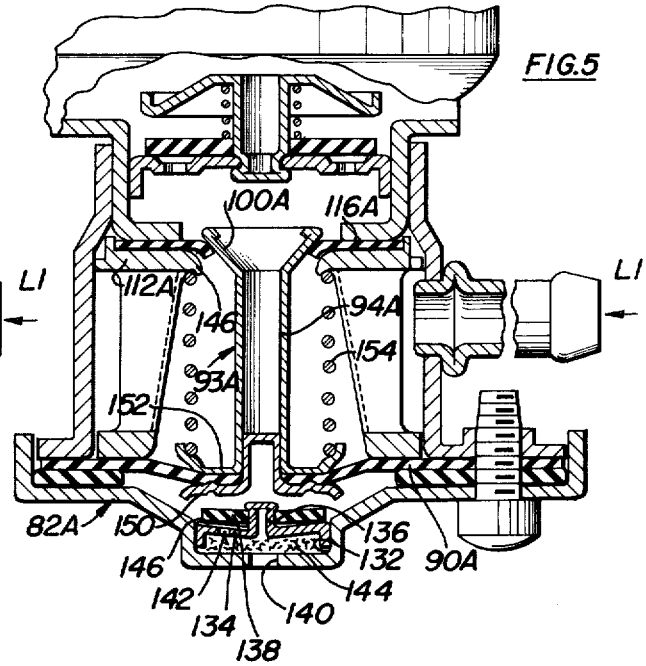
FIG. 5 is a separate embodiment of this invention showing a different arrangement of a vent valve structure and a separate means for urging the diaphragm toward a closed position of the shut-off valve.

Referring now to FIG. 5, a separate embodiment of the invention is illustrated in which cap 82A has a recess 132 formed therein in which a seat member 134 is press fitted. A stem 136 on seat 134 retains a valve member 138. A vent 140 is provided in cap 82A and a vent 142 is arranged in seat 134. A filter material 144 is provided in the space adjacent seat 134. A slot 146 along the upper surface of seat 136 is in fluid communication with vent 142 and permits a fluid communication with vent 142 at all times.

A shut-off valve structure 93A has a stem 94A with an upper head portion 100A forming the valve member. A valve seal 116A is provided adjacent valve head 100A and filter 108A has an upper annular end portion 112A with an inner annular flange 146. Stem 94A has at its lower end a pair of plates 150 and 152 gripping diaphragm 90A therebetween. Upper plate 152 is formed with a spring retainer to receive a spring 154 biased between plate 152 and upper end portion 112A while being retained in position at its upper end by flange 146. Spring 154 continuously urges diaphragm 90A toward a downward position as shown in FIG. 5. Upon movement of diaphragm 90A and valve member 100A toward an open position, valve member 138 is moved upwardly from slot 146 thereby to provide a fast rate of air flow within the space formed beneath diaphragm 90A and a fast movement of valve 100A to open position. When diaphragm 90A moves downwardly, valve member 138 seats on seat 134 and a relatively slow rate of air is bled outwardly through slot 146, vents 142 and 140 to atmosphere. Thus, the shut-off valve shown in FIG. 5 operates in a manner similar to that shown in FIG. 2.

Figure 6:
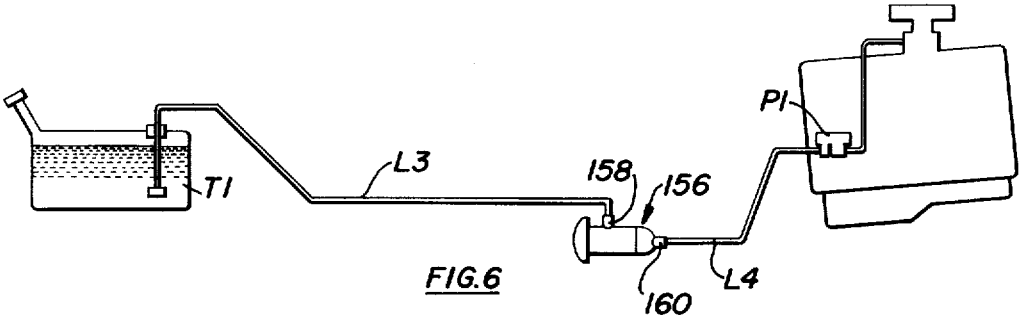
FIG. 6 is an elevational view, partly schematic, illustrating the shut-off valve of the present invention in the fuel line between the fuel pump and the fuel supply.
Figure 7:
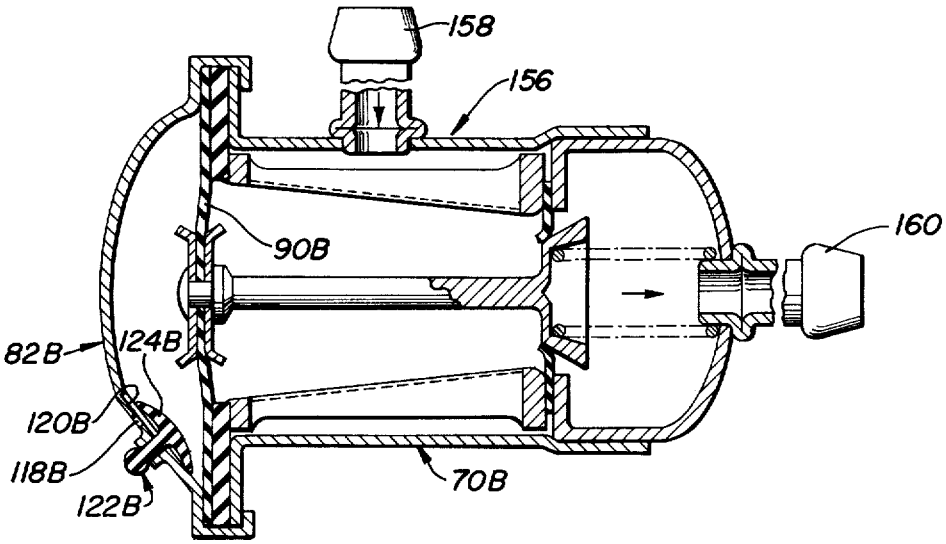
FIG. 7 is a longitudinal section of the shut-off valve shown in FIG. 6.

Referring to FIGS. 6 and 7, a separate embodiment of the invention is disclosed in which a shut-off valve indicated generally at 156 is positionedin the fuel line between the fuel container T1 and fuel pump P1. Inlet line L3 leads to shut-off valve 156 and outlet line L4 leads from shut-off valve 156 to fuel pump P1. An inlet nipple 158 is connected to line L3 and an outlet nipple 160 is connected to line L4. A diaphragm 90B is gripped between cap 82B and housing 70B of shut-off valve 156. A vent valve 122B includes a valve 124B fitting over a slot 120B which is in fluid communication with vent 118B. Valve 122B functions in a manner similar to that of the embodiment shown in FIGS. 1–4. The above arrangement is particularly adapted for use on existing automobiles in which shut-off valve 156 may be provided as a retrofit. The functioning of shut-off valve 156 is generally identical to the functioning of the shut-off valve shown in the embodiments of FIGS. 1–4.

What is claimed is:

1. In a fuel system the combination of a shut-off valve and a fuel pump, said shut-off valve structure being positioned in the feed line of an automotive vehicle between the fuel supply and the inlet valve of said fuel pump comprising an outer circumferential housing, a cap secured adjacent an end of said housing, a flexible diaphragm secured between the cap and housing to define an air chamber between the cap and one side of the diaphragm and a fuel chamber adjacent the other side of the diaphragm, a fuel inlet extending through the housing and in fluid communication with the fuel chamber, a shut-off valve member connected to the diaphragm for movement therewith and an outlet for the fuel chamber receiving the valve member for movement between open and closed positions relative to the outlet, said cap having a vent opening therein to permit the bleeding in and exhaust of air from the air chamber, and a vent valve structure on the cap adjacent the vent opening for controlling the flow of air through the vent opening, said vent valve structure providing a relatively fast rate of air flow within the air chamber during movement of the diaphragm and shut-off valve member toward an open position and providing a relatively slow rate of air flow from the air chamber during movement of the diaphragm and shut-off valve member toward a closed position.

2. A shut-off valve structure as set forth in claim 1 in which the shut-off valve structure and said housing are an integral portion of the fuel pump and is positioned adjacent an inlet check valve of the said fuel pump.

3. A shut-off valve structure as set forth in claim 1 in which the shut-off valve is spaced from the fuel pump in the fuel line between the fuel pump and the fuel tank.

4. A shut-off valve structure as set forth in claim 1 in which the vent valve structure comprises a vent valve member positioned over said vent opening and a longitudinal slot in fluid communication with the vent opening extends from said vent opening outwardly of the vent valve member to provide a bypass for air when the vent valve structure is in a closed position.

5. In a fuel system the combination of a shut-off valve and a fuel pump, said shut-off valve structure being positioned in the feed line of an automotive vehicle between the fuel supply and the inlet valve of said fuel pump comprising an outer circumferential housing, a cap secured adjacent an end of said housing, a flexible diaphragm secured between the cap and housing to define an air chamber between the cap and one side of the diaphragm and a fuel chamber adjacent the other side of the diaphragm, a fuel inlet extending through the housing and in fluid communication with the fuel chamber, a shut-off valve member connected to the diaphragm for movement therewith and an outlet for the fuel chamber receiving the valve member for movement between open and closed positions relative to the outlet, said cap having a vent opening therein to permit the bleeding in and exhaust of air from the air chamber, and a vent valve structure on the cap adjacent the vent opening for controlling the flow of air through the vent opening, said vent valve structure upon movement of the shut-off valve member toward an open position moving to an open position and permitting a relatively fast rate of air flow within the air chamber through the vent opening, and upon movement of the shut-off valve member toward a closed position moving to a closed position and permitting a relatively slow rate of air flow from the air chamber through an air passage bypassing the vent valve structure.

6. A shut-off valve structure as set forth in claim 5 wherein said vent valve structure includes a valve seat positioned within a recess in the inner surface of said cap and having an air opening therein, a disc-valve member positioned on said seat over said air opening, spring means urging the disc-valve member toward a closed position seated on said valve seat, and an air bypass in fluid communication with said air opening permitting the flow of air around the disc-valve member when in a closed position.

7. A shut-off valve structure as set forth in claim 5 wherein said shut-off valve member comprises a rod connected to said diaphragm adjacent one end and an enlarged head against the other end, and a resilient annular seal fixed to the housing adjacent said head contacts said head in a closed position to form a fluid-tight seal therebetween, said outlet for the fuel chamber being formed between the annular seal and said head.

8. A shut-off valve structure as set forth in claim 7 wherein said head has a recess therein and a spring is seated within said recess to urge the diaphragm and shut-off valve member toward a closed position.

* * * * *